US008608260B2

(12) United States Patent
Wishlade

(10) Patent No.: US 8,608,260 B2
(45) Date of Patent: Dec. 17, 2013

(54) INTEGRATED GARAGE WORKSTATION

(75) Inventor: Dominic Robert Wishlade, Brackley (GB)

(73) Assignee: Dura Limited, Northamtonshire (GB)

( * ) Notice: Subject to any disclaimer, the term of this patent is extended or adjusted under 35 U.S.C. 154(b) by 202 days.

(21) Appl. No.: 13/135,568

(22) Filed: Jul. 8, 2011

(65) Prior Publication Data

US 2012/0007483 A1 Jan. 12, 2012

(30) Foreign Application Priority Data

Jul. 10, 2010 (GB) ..... 1011612.7

(51) Int. Cl.
*A47B 95/02* (2006.01)

(52) U.S. Cl.
USPC ..... 312/319.8

(58) Field of Classification Search
USPC ..... 312/319.8, 237, 352, 249.8–249.9, 312/249.11–249.13
See application file for complete search history.

(56) References Cited

U.S. PATENT DOCUMENTS 2,845,780 A * 8/1958 Conklin et al. ..... 62/291
2,855,260 A * 10/1958 Reiss et al. ..... 312/265.4
3,829,773 A * 8/1974 Nigg ..... 324/114
3,868,903 A * 3/1975 Montalbano ..... 100/45
3,874,531 A * 4/1975 Mayo ..... 414/680
3,999,640 A * 12/1976 Persson ..... 191/12.4
4,373,761 A * 2/1983 Hansberry, Jr. ..... 312/249.12
4,429,931 A * 2/1984 Brooks ..... 312/228
4,759,560 A * 7/1988 Virgulti ..... 280/47.26
4,880,248 A * 11/1989 Elmer ..... 280/47.35
4,976,450 A * 12/1990 Ellefson ..... 280/79.11
4,986,617 A * 1/1991 McConkey ..... 312/237
4,989,291 A * 2/1991 Parent ..... 15/315
5,069,466 A * 12/1991 Propst ..... 280/79.3
5,113,546 A * 5/1992 Parent ..... 15/315
5,183,372 A * 2/1993 Dinverno ..... 414/538
5,242,032 A * 9/1993 Prestwood et al. ..... 184/1.5
5,330,263 A * 7/1994 Wilkinson ..... 312/328
5,577,817 A * 11/1996 Reynolds ..... 312/107
6,095,156 A * 8/2000 Smith, II ..... 132/286
6,138,558 A * 10/2000 Harrington ..... 100/102
6,305,049 B1 * 10/2001 Koch ..... 16/110.1
6,315,376 B1 * 11/2001 Wiseman ..... 312/249.8
7,856,998 B2 * 12/2010 Bauer ..... 137/15.16
8,084,992 B2 * 12/2011 Scheffy et al. ..... 320/114
8,162,330 B2 * 4/2012 Melkumyan et al. ..... 280/47.34
8,360,538 B2 * 1/2013 Retchloff ..... 312/352
2002/0074905 A1 * 6/2002 Tiramani et al. ..... 312/108

(Continued)

*Primary Examiner* — Hanh V Tran
(74) *Attorney, Agent, or Firm* — Ira S. Dorman

(57) ABSTRACT

The workstation includes a cabinet 100 having a worktop 101 and a compartment 3 for tool storage, a compartment containing a paper towel dispenser, a compartment 7 which contains a waste bin, and compartments 6, 9 housing self-retracting hose reels for air and water. The hose reel compartments are recessed behind the front face of the cabinet to accommodate hose end fittings, and may occupy a lower portion of the cabinet. The space above may be occupied by a panel containing electrical and/or data connectors, the paper towel dispenser, and a dispenser for latex gloves. A further compartment 8 houses a personal computer carried by a drawer mounted on runners. An upstanding pegboard 30 is mounted on vertical sliders and operated by pneumatic cylinders or an electric motor allowing it to be stowed behind the rear of the cabinet when not in use. A flat screen monitor 40 is mounted on the pegboard, and a keyboard holder 42 may be provided for storing a computer keyboard in a vertical plane.

12 Claims, 4 Drawing Sheets

(56) References Cited

U.S. PATENT DOCUMENTS

2005/0082955 A1* 4/2005 Kuelbs et al. ..... 312/245
2005/0280228 A1* 12/2005 Fernandes et al. ..... 280/47.35
2007/0216267 A1* 9/2007 Johanning ..... 312/294
2009/0058245 A1* 3/2009 He ..... 312/401

* cited by examiner

INTEGRATED GARAGE WORKSTATION

TECHNICAL FIELD OF THE INVENTION

This invention relates to an integrated garage workstation for use in workshops.

BACKGROUND

Garage workshops require a large number of facilities, but most garages purchase each item of equipment separately, often at different times. As a result, the equipment tends to be installed in any available space, with the end result that, over time, the workshop becomes cluttered, inefficient, and possibly even dangerous.

The present invention seeks to provide a new and inventive form of garage workstation which integrates the main facilities commonly required by a garage workshop into one ergonomic, tidy and easily installed unit.

SUMMARY OF THE INVENTION

The present invention proposes an integrated garage workstation which includes a cabinet having a worktop and providing a compartment for tool storage, a compartment containing a paper towel dispenser, a compartment which receives a waste bin, and at least one compartment housing a self-retracting hose reel.

The or each compartment containing the self-retracting hose reel is preferably recessed behind the front face of the cabinet to accommodate a hose end fitting. Each such compartment preferably occupies a lower portion of the cabinet. The space above may be occupied by a panel containing electrical and/or data connectors, the paper towel dispenser, and a dispenser for latex gloves. Preferably the cabinet provides compartments containing two self-retracting hose reels for air and water, which are preferably located at opposite ends of the cabinet.

The waste bin is preferably hinged at the lower front edge of the respective compartment to pivot angularly out of the cabinet.

The utility of the workstation may be improved even further by including a further compartment for housing a personal computer. The compartment preferably contains a drawer mounted on runners for moving the computer in and out of the cabinet.

The cabinet may be mounted on spaced bearers extending in a front-rear direction so that the forks of a fork-lift truck may be inserted under the cabinet.

In a further enhancement a pegboard is provided, upstanding from the rear of the cabinet. The pegboard is preferably mounted on vertical sliders allowing the pegboard to be lowered and stowed at the rear of the cabinet when not in use. The pegboard may be raised by pneumatic cylinders or an electric motor for example.

A flat screen monitor may conveniently be mounted on one side of the pegboard, and a keyboard holder may be mounted at the rear of the worktop for storing a computer keyboard in a substantially vertical plane.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
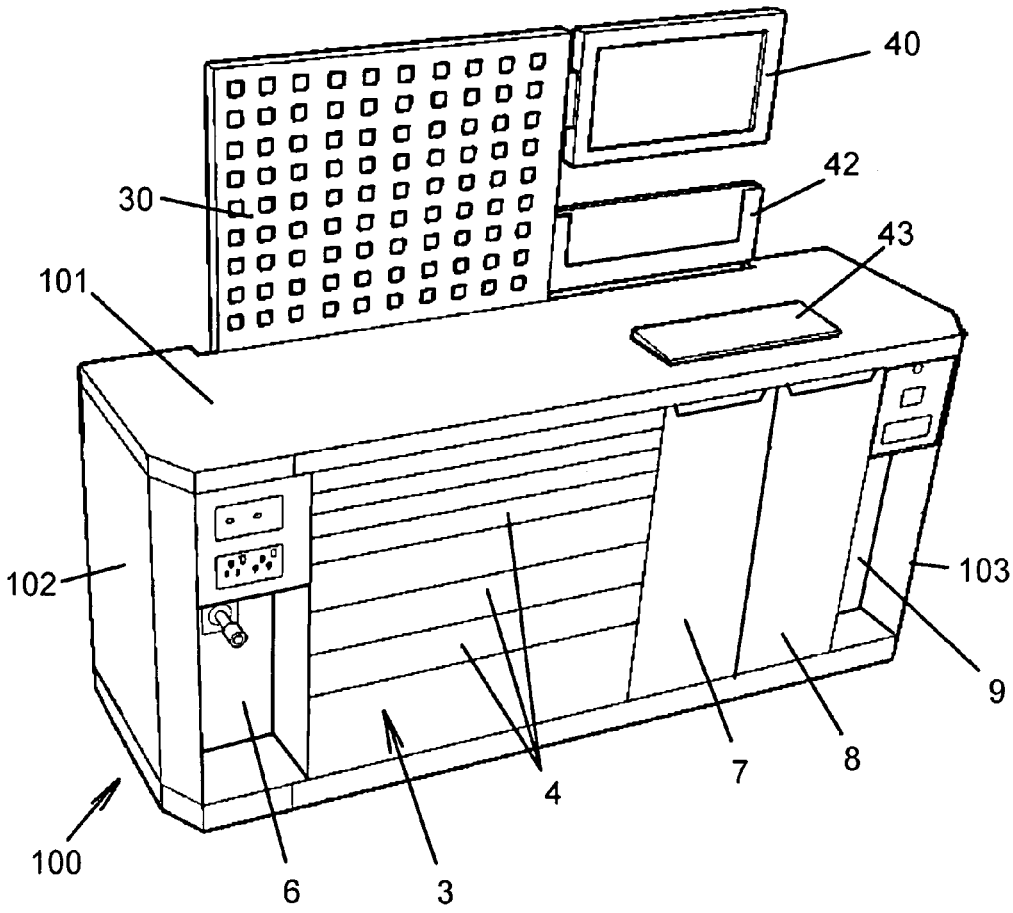
FIG. 1 is a general view of an integrated garage workstation in accordance with the invention.
Figure 2:
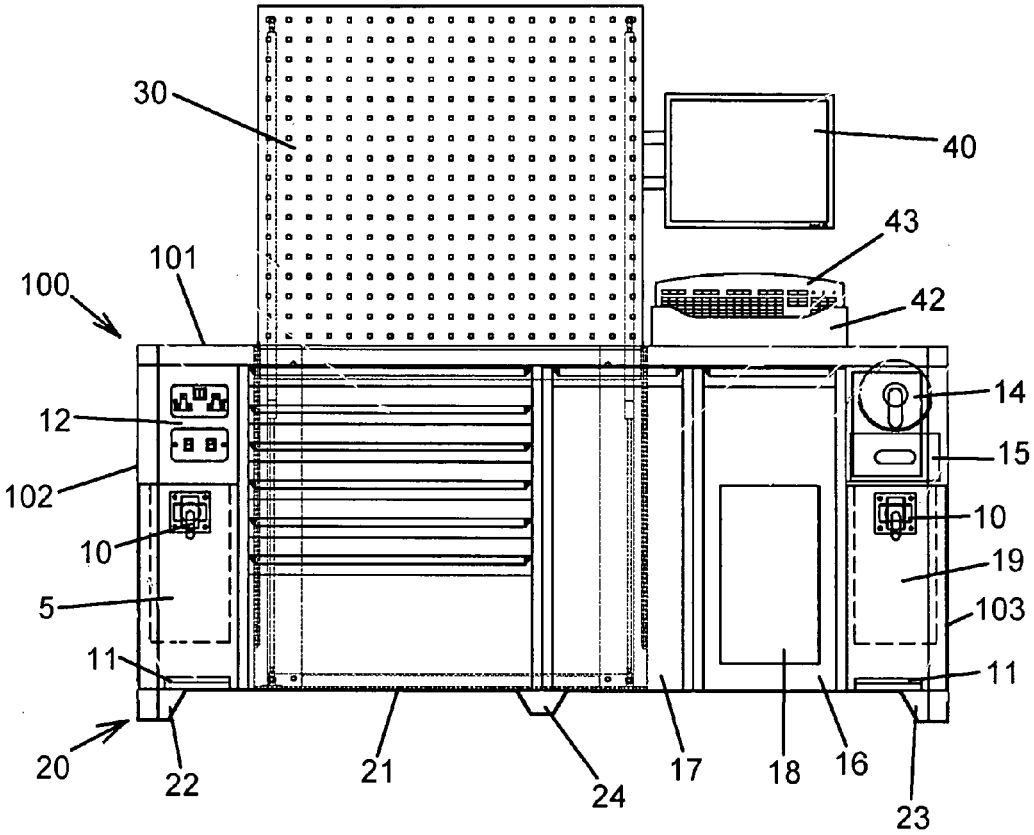
FIG. 2 is a front view of the workstation.
Figure 3:
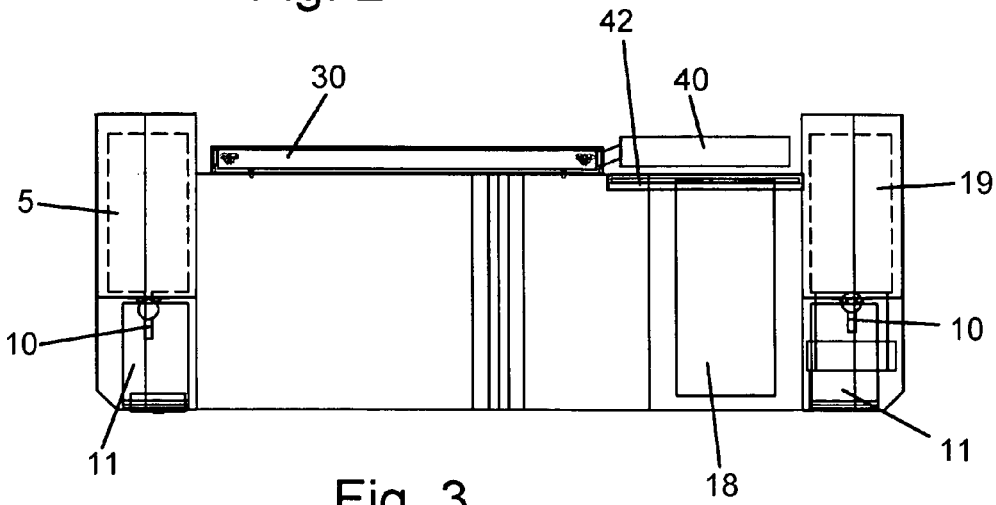
FIG. 3 is a plan view of the workstation.
Figure 4:
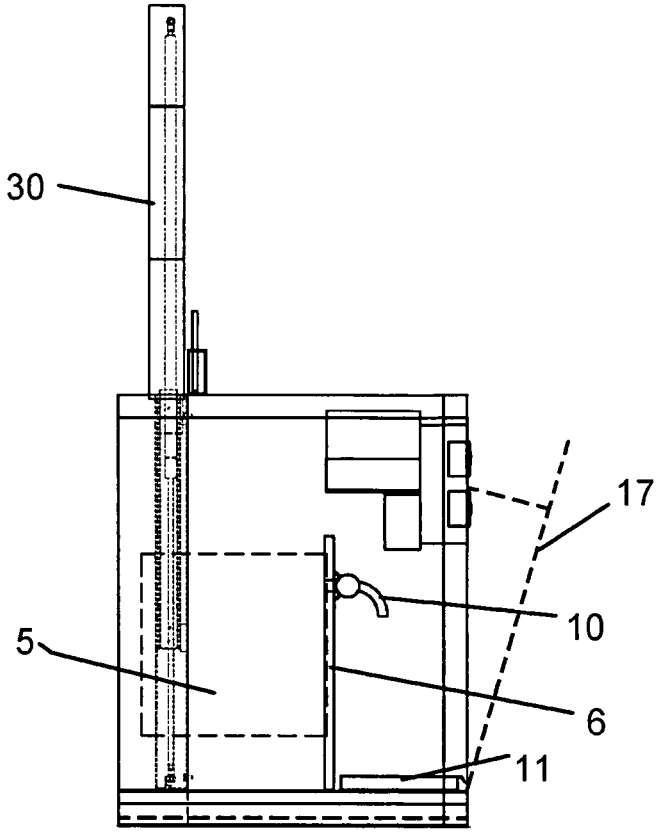
FIG. 4 is a side view of the workstation.

Referring firstly to FIGS. 1 and 2, the garage workstation includes a cabinet 100 which provides an elongate worktop 101 supported by a rigid frame enclosed between end panels 102 and 103. The front face of the cabinet provides access to various useful workshop facilities, including a first compartment 3 housing a stack of drawers 4 suitable for storage of general items and various tools such as hammers, screw drivers, spanners, wrenches etc. Immediately to the left of the drawers there is a self-retracting hose reel 5 housed within a compartment 6. The reel carries an air hose which, in use, is coupled to the garage compressed air supply via a suitable coupling at the rear of the workstation (not shown). To the right of the drawers there are further enclosed compartments 7, 8 and 9, respectively housing a waste bin 17, a tower-type personal computer (PC) 18, and a second self-retracting hose reel 19 carrying a water hose which, in use, is coupled to a suitable water supply via a further coupling at the rear of the workstation (also not shown). Compartments 6-9 are tall and narrow, the compartments 7 and 8 for the bin and the PC being substantially full-height. The two outer compartments 6 and 9 containing the two hose reels only occupy a lower portion of the workstation and, as shown in FIGS. 3 and 4, these compartments are recessed behind the front of the cabinet to allow space to accommodate the hose end fittings 10 when the hoses are fully retracted. A removable drip tray 11 may be provided beneath one or both of the end fittings 10. Above the left compartment 6 is a panel 12 (FIG. 2) carrying electrical power sockets, data connections and the like, while the space above the right compartment 9 forms an alcove occupied by a paper towel dispenser 14 and a dispenser 15 for latex gloves. The dispensers can be locked in the alcove, but when released, may be withdrawn from the front of the cabinet to provide a fresh supply of towels or gloves.

The PC compartment 8 is provided with a PC storage drawer 16 (preferably lockable) which, using a handle formed by a cutout at the top, can be slid out of the cabinet on runners to allow withdrawal of the PC 18 for easy access. When the drawer is slid back into the cabinet the PC is fully enclosed and protected from contamination by dust and dirt.

The waste bin 17 may be hinged to the cabinet frame along the bottom front edge so that the bin can be tilted forwards from compartment 7, as shown in dashed outline in FIG. 4, by means of a handle formed by a cutout at the top edge. The bin 17 may be provided with a removable liner to receive used towels and latex gloves, and other items of non-toxic workshop waste.

Returning to FIG. 2, the cabinet is mounted on a base 20 which incorporates a plinth plate 21 supported by box-section bearers 22 and 23, and optionally one or more intermediate bearers 24, all of which extend in a front-to-rear direction. The spacing between the bearers is such that the forks of a fork-lift truck can be inserted between them to move the workstation when required.

Figure 5:
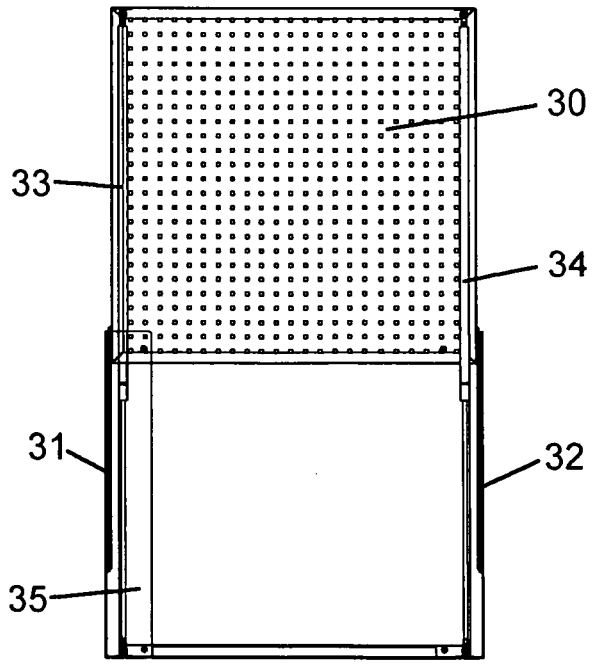
FIG. 5 is a rear view of a retractable pegboard which is incorporated in the workstation.
Figure 6:
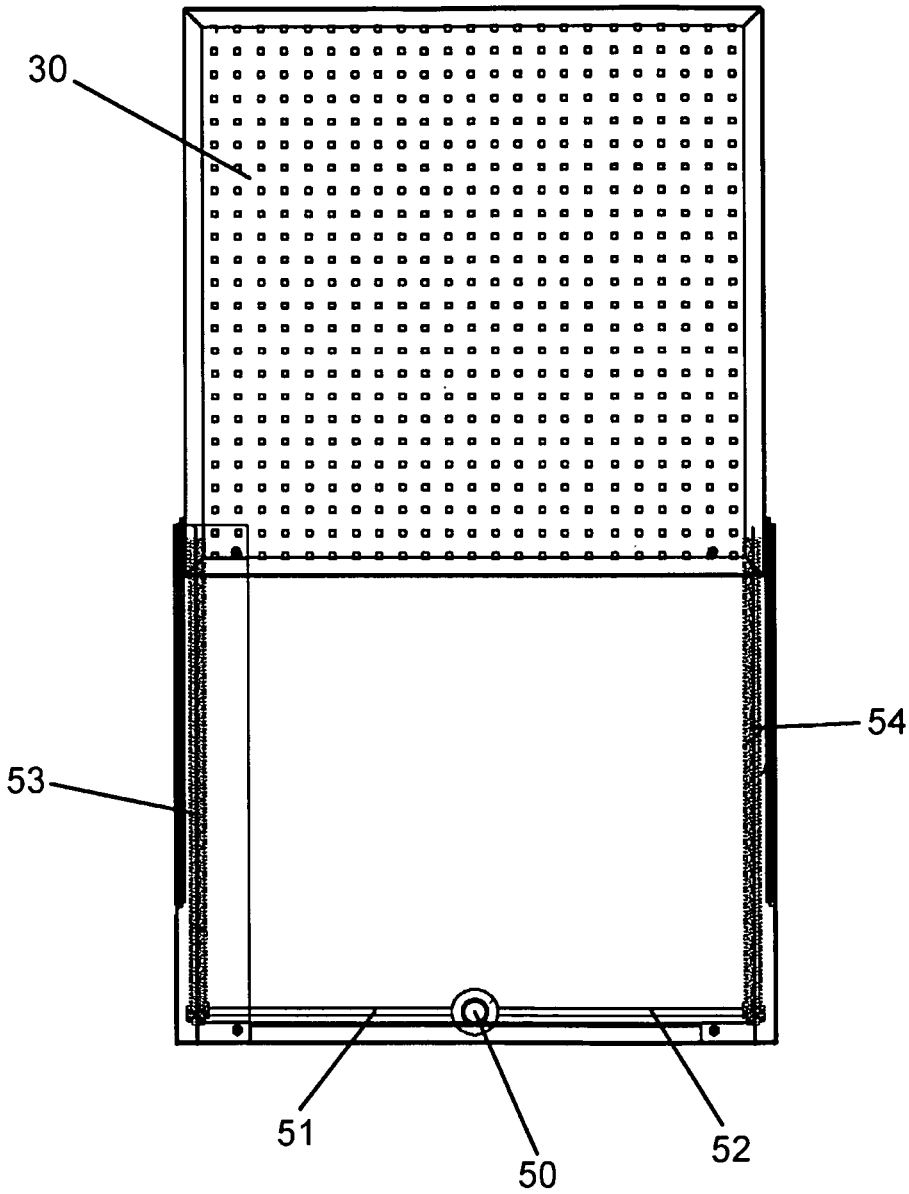
FIG. 6 is a rear view of an alternative form of retractable pegboard.

At the rear of the worktop 1 there is an upstanding pegboard 30 upon which tools or other items can be hung when they are not being used. As shown in FIG. 5, the pegboard is mounted between spaced vertical sliders 31 and 32 which act as guides to allow the pegboard to be smoothly raised and lowered, enabling the pegboard and the tools thereon to be stored behind the rear of the cabinet when not in use. A forwardly-projecting frame may extend around the periphery of the pegboard to partially enclose the tools and clearly define a front boundary beyond which the tools should not project to avoid fouling the cabinet when the pegboard is raised and lowered. The pegboard is preferably moved by powered means. In FIG. 5 single-acting pneumatic cylinders 33 and 34 are mounted on opposite sides of the pegboard, normally enclosed behind covers 35, although the right hand cover has been omitted for clarity. The cylinders may be operated from the workshop compressed air supply using standard directional control valves. However, when a compressed air supply is not available, or convenient, another option is to use an electric motor to move the pegboard as shown in FIG. 6. A single motor 50 mounted centrally at the base of the pegboard 30 operates a pair of drive shafts 51 and 52 via a gearbox and worm drive. The drive shafts in turn move the pegboard via a rack-and-pinion system 53, 54, toothed belts etc.

Referring back to FIGS. 1 and 2, a flat screen PC monitor 40, wired to the PC 18, is attached to the right hand side of the pegboard 30 so that the monitor is also retracted behind the cabinet when the pegboard is lowered. A keyboard holder 42 is mounted on the worktop 1 in front of the monitor 40 so that the PC keybard 43 can conveniently be stored in an upright position when not in use. When the keyboard is required it can be removed from the holder and placed on the worktop 1, as in FIG. 1.

In a modification the paper towel and glove dispensers may be mounted above the waste bin instead of the hose reel. Since used towel and gloves are normally discarded into the bin this may be a more ergonomic grouping.

The workstation thus provides many of the items required by a busy garage workshop in one convenient, ergonomic and compact unit.

Whilst the above description places emphasis on the areas which are believed to be new and addresses specific problems which have been identified, it is intended that the features disclosed herein may be used in any combination which is capable of providing a new and useful advance in the art.

The invention claimed is:

1. An integrated garage workstation which includes a cabinet having a worktop and end panels and providing a compartment for tool storage, a compartment containing a paper towel dispenser, a compartment which receives a waste bin, and compartments containing two self-retracting hose reels for air and water, said compartments containing the self-retracting hose reels being located at opposite ends of the cabinet adjacent to said end panels, said compartment for tool storage and said compartment which receives a waste bin being located between said compartments containing the self-retracting hose reels, and a front face of each of the compartments containing the self-retracting hose reels being recessed behind a front face of said compartment for tool storage and said compartment which receives a waste bin.

2. An integrated garage workstation according to claim 1 in which one of said compartments containing the self-retracting hose reels occupies a lower portion of the cabinet, and a space above said compartment containing the self-retracting hose reel is occupied by a panel containing electrical and/or data connectors.

3. An integrated garage workstation according to claim 1 in which one of said compartments containing the self-retracting hose reels occupies a lower portion of the cabinet, and said compartment containing the paper towel dispenser is located in a space above said compartment contain-ing the self-retracting hose reel.

4. An integrated garage workstation according to claim 1 in which one of said compartments containing the self-retracting hose reels occupies a lower portion of the cabinet and a space above said compartment containing the self-retracting hose reel contains a dispenser for latex gloves.

5. An integrated garage workstation according to claim 1 in which the compartment containing the waste bin substantially occupies the full height of the cabinet.

6. An integrated garage workstation according to claim 1 in which the waste bin is hinged at a lower front edge of the compartment in which it is contained, to permit the waste bin to pivot angularly out of the cabinet.

7. An integrated garage workstation according to claim 1 in which the cabinet contains a further compartment for housing a personal computer.

8. An integrated garage workstation according to claim 7 in which the compartment for housing a personal computer contains a drawer for moving the personal computer in and out of the cabinet.

9. An integrated garage workstation according to claim 7 in which the further compartment for housing a personal computer substantially occupies the full height of the cabinet.

10. An integrated garage workstation which includes a cabinet having a worktop and providing a compartment for tool storage, a compartment containing a paper towel dispenser, a compartment which receives a waste bin, a compartment for housing a personal computer, and at least one compartment housing a self-retracting hose reel; a pegboard upstanding from a rearward portion of the cabinet, said pegboard being mounted on sliders allowing the pegboard to be lowered and stowed at the rear of the cabinet; powered means for raising the pegboard; a flat screen monitor mounted on one side of the pegboard and substantially coplanar therewith to be raised and lowered with the pegboard; and a keyboard holder mounted on the rearward portion of the worktop in front of the flat screen monitor for storing a computer keyboard in a substantially vertical plane.

11. An integrated garage workstation according to claim 10 in which the powered means for raising the pegboard comprises pneumatic cylinders.

12. An integrated garage workstation according to claim 10 in which the powered means for raising the pegboard comprises an electric motor.

* * * * *